US008839950B2

(12) United States Patent
Bell

(10) Patent No.: US 8,839,950 B2
(45) Date of Patent: Sep. 23, 2014

(54) PACKAGING FOR WRITING INSTRUMENTS

(71) Applicant: Office Depot, Inc., Boca Raton, FL (US)

(72) Inventor: Grant Bell, Davie, FL (US)

(73) Assignee: Office Depot, Inc., Boca Raton, FL (US)

( * ) Notice: Subject to any disclaimer, the term of this patent is extended or adjusted under 35 U.S.C. 154(b) by 0 days.

(21) Appl. No.: 13/790,838

(22) Filed: Mar. 8, 2013

(65) Prior Publication Data

US 2013/0299367 A1 Nov. 14, 2013

Related U.S. Application Data

(60) Provisional application No. 61/644,747, filed on May 9, 2012.

(51) Int. Cl.

| | |
|---|---|
| ***A45C 11/00*** | (2006.01) |
| ***B65D 85/28*** | (2006.01) |
| ***B43K 23/12*** | (2006.01) |

(52) U.S. Cl.

CPC ..... *A45C 11/00* (2013.01); *B65D 85/28* (2013.01); *B43K 23/12* (2013.01)

USPC ..... 206/214; 206/371; 206/461

(58) Field of Classification Search

CPC ..... B65D 85/28; B43K 23/12; A45C 11/00; A45C 11/34

USPC ..... 206/214, 371, 461–463, 471, 495, 779, 206/806; 53/133.3, 133.5–133.6, 133.8

IPC ..... B65D 85/28; A45C 11/00, 11/34

See application file for complete search history.

(56) References Cited

U.S. PATENT DOCUMENTS

| | | | | | |
|---|---|---|---|---|---|
| 1,784,952 | A | * | 12/1930 | Wolfson | 434/103 |
| 2,412,938 | A | * | 12/1946 | Amoth | 211/69.5 |
| 2,850,152 | A | * | 9/1958 | Marrufo | 206/234 |
| 3,002,722 | A | * | 10/1961 | Cote | 248/174 |
| 3,157,275 | A | * | 11/1964 | Tolaas | 206/780 |
| 4,189,048 | A | * | 2/1980 | Gaillard | 206/37 |
| 4,721,204 | A | * | 1/1988 | Shee | 206/210 |
| 5,048,677 | A | * | 9/1991 | Pedracine | 206/573 |
| 5,240,110 | A | * | 8/1993 | Reichenbach et al. | 206/462 |
| 5,392,919 | A | * | 2/1995 | Passamoni | 206/576 |
| 5,622,258 | A | * | 4/1997 | Baublitz et al. | 206/349 |
| 5,899,329 | A | * | 5/1999 | Hu et al. | 206/376 |
| 6,029,816 | A | * | 2/2000 | Goodwin et al. | 206/371 |
| D434,647 | S | * | 12/2000 | Appelbaum et al. | D9/415 |
| 6,311,839 | B1 | * | 11/2001 | Lo | 206/371 |

(Continued)

FOREIGN PATENT DOCUMENTS

EP 823227 A2 * 2/1998

*Primary Examiner* — Mickey Yu
*Assistant Examiner* — Brijesh V. Patel
(74) *Attorney, Agent, or Firm* — Greenberg Traurig, LLP

(57) ABSTRACT

A packaging includes a first section comprising an upper section configured to secure an upper portion of a writing instrument within the packaging; a lower section configured to secure a writing end of the writing instrument within the packaging; and an intermediate section configured to allow a user to grasp entirely a middle portion of the writing instrument; and a second section configured to secure at least one additional writing instrument, wherein the first section is adjacent to the second section.

19 Claims, 5 Drawing Sheets

(56) References Cited

U.S. PATENT DOCUMENTS

| | | | | |
|---|---|---|---|---|
| 6,364,100 | B1 * | 4/2002 | Leibeck | 206/45.23 |
| D476,562 | S * | 7/2003 | Vasudeva | D9/415 |
| 2004/0222118 | A1 * | 11/2004 | Melgaard | 206/461 |
| 2004/0251153 | A1 * | 12/2004 | Chen | 206/375 |
| 2005/0218027 | A1 * | 10/2005 | Lammers et al. | 206/467 |
| 2006/0216677 | A1 * | 9/2006 | Grosso | 434/162 |
| 2007/0014626 | A1 * | 1/2007 | Claussen | 401/258 |
| 2013/0248388 | A1 * | 9/2013 | Jimenez et al. | 206/214 |

* cited by examiner

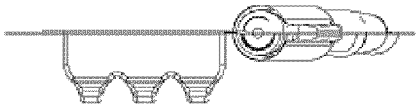
FIG. 1D
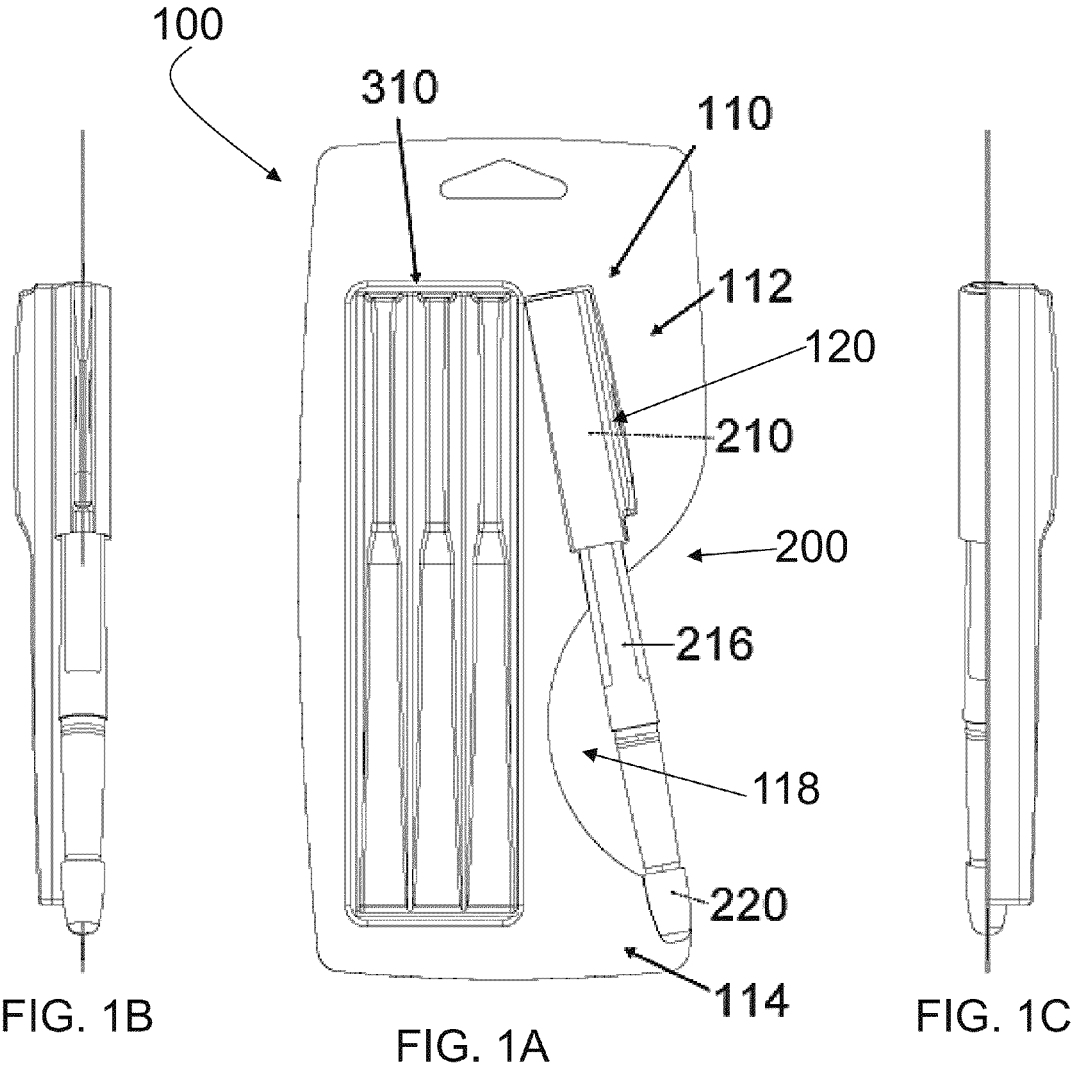
FIG. 1B
FIG. 1A
FIG. 1C
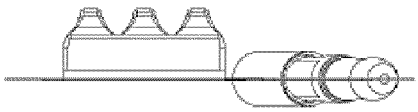
FIG. 1E

PACKAGING FOR WRITING INSTRUMENTS

RELATED APPLICATION

This application claims the benefit of, and priority to, U.S. Provisional Patent Application No. 61/644,747, filed on May 9, 2012, the entirety of this application is hereby incorporated herein by reference.

BACKGROUND

Packaging of consumer products plays a role in marketing and purchase decisions. Current writing instrument packaging does not allow for much user interaction. For example, there is limited or no way for a consumer to grasp entirely at least a portion of a writing instrument in the packaging prior to purchase.

SUMMARY

According to aspects illustrated herein, in an embodiment there is disclosed a packaging that includes a first section comprising an upper section configured to secure an upper portion of a writing instrument within the packaging; a lower section configured to secure a writing end of the writing instrument within the packaging; and an intermediate section configured to allow a user to grasp entirely a middle portion of the writing instrument; and a second section configured to secure at least one additional writing instrument, wherein the first section is adjacent to the second section.

BRIEF DESCRIPTION OF THE DRAWINGS

The presently disclosed embodiments will be further explained with reference to the attached drawings, wherein like structures are referred to by like numerals throughout the several views. The drawings shown are not necessarily to scale, with emphasis instead generally being placed upon illustrating the principles of the presently disclosed embodiments.

FIGS. 1A-H depict various views of an illustrative embodiment of a packaging of the present invention. FIG. 1A shows a front view of the packaging. FIGS. 1B and 1C show side views of the packaging. FIGS. 1D and 1E show top and bottom views, respectively, of the packaging. FIG. 1F shows a perspective view of the packaging. FIGS. 1G and 1H show perspective views of a writing instrument of the packaging. As illustrated, the packaging includes writing instruments.

FIG. 2A shows a front view of the packaging. FIG. 2B shows a side view of the packaging. FIG. 2C shows a top view of the packaging. FIG. 2D shows a perspective view of the packaging. As illustrated, the packaging includes writing instruments.

FIG. 3A shows a front view of the packaging. FIG. 3B shows a side view of the packaging. FIG. 3C shows a top views of the packaging. FIG. 3D shows a perspective view of the packaging. FIGS. 3E and 3F show perspective views of a writing instrument of the packaging. As illustrated, the packaging includes writing instruments.

Figure 1F:
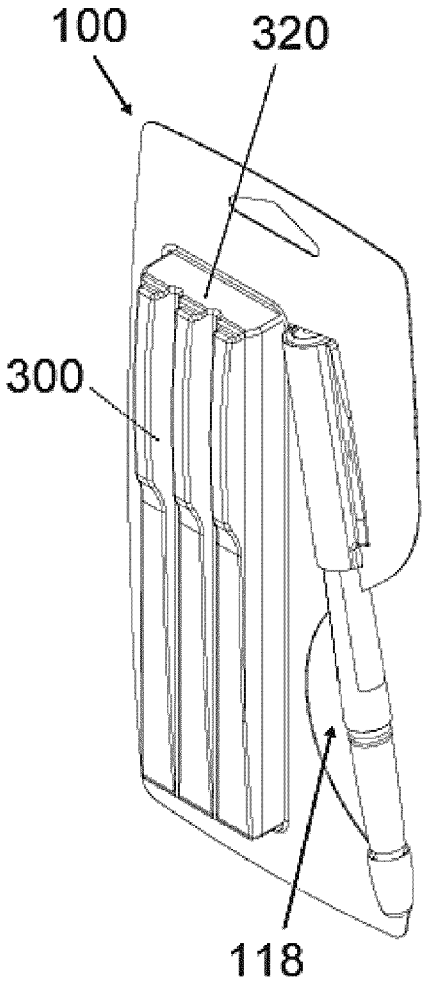

While the above-identified drawings set forth presently disclosed embodiments, other embodiments are also contemplated, as noted in the discussion. This disclosure presents illustrative embodiments by way of representation and not limitation.

DETAILED DESCRIPTION

The present invention is now discussed in more detail referring to the drawings that accompany the present application. In the accompanying drawings, like and/or corresponding elements are referred to by like reference numbers.

A packaging of the present invention allows for a writing instrument to be securely packaged while still allowing a consumer to feel the middle portion of the writing instrument in the same way a user would hold a pen while writing.

As used herein, the term "writing instrument" refers to an object used to produce writing. Examples of writing instruments include, but are not limited to, pens and mechanical pencils.

As used herein, the term "packaging" refers to the science, art, and technology of enclosing or protecting at least one writing instrument for distribution, storage, sale, and use.

As used herein, the term "securing" refers to keeping stable, fixed and/or protected a portion of a writing instrument.

As used herein, the term "writing end of the writing instrument" is that portion of the writing instrument from which ink flows. In some embodiments, the writing end of the writing instrument is referred to as the writing tip or point. In an embodiment, the writing tip or point dispenses viscous oil-based ink. In an embodiment, the writing tip or point uses water-based liquid ink delivered through a nib. In an embodiment, the writing tip or point has a porous tip of fibrous material. In an embodiment, the writing tip or point dispenses a water-based liquid or gel ink through a ball tip.

As used herein, the term "upper portion of the writing instrument" refers to that end of the writing instrument that is opposite the writing end of the writing instrument. In an embodiment, the upper portion of the writing instrument includes an upper portion of the barrel of the writing instrument.

As used herein, the term "middle portion of the writing instrument" refers to a portion of the writing instrument that is neither the upper portion or the writing end. In an embodiment, the middle portion of the writing instrument includes a middle portion of the barrel of the writing instrument. In an embodiment, the barrel of the writing instrument is generally tubular in shape. In an embodiment, the barrel of the writing instrument has a hollow channel extending therethrough. In an embodiment, the middle portion of the writing instrument includes a touch grip of the writing instrument. In an embodiment, the middle portion of the writing instrument includes both the middle portion of the barrel and the touch grip.

As used herein, the term "intermediate section" refers to that portion of a packaging of the present invention that is in a substantially middle position, i.e., that portion that is between the upper section and the lower section of the packaging.

As used herein, in an embodiment the term "encloses" refers to at least a portion of a writing instrument that is surrounded on all sides. In an embodiment, a barrel portion of a writing instrument is surrounded on all sides or closed in by packaging material. In an embodiment, the entire writing instrument is entirely surrounded on all sides or closed in by packaging material. It should be understood that in an embodiment, "the entire writing instrument" is meant all components of the writing instrument excluding the clip.

As used herein, the term "grasp entirely" refers to the capability of a user to take hold of the barrel and or touch grip of a writing instrument or to seize firmly the barrel and or touch grip of a writing instrument in the same way a user would hold the writing instrument while writing. In an embodiment, the grasping occurs via a user's fingers. In an embodiment, the grasping occurs via a user's toes.

As used herein, the term "separate" refers to different sections of a packaging of the present invention that are kept apart, disunited from one another.

Figures 1G, 1H:
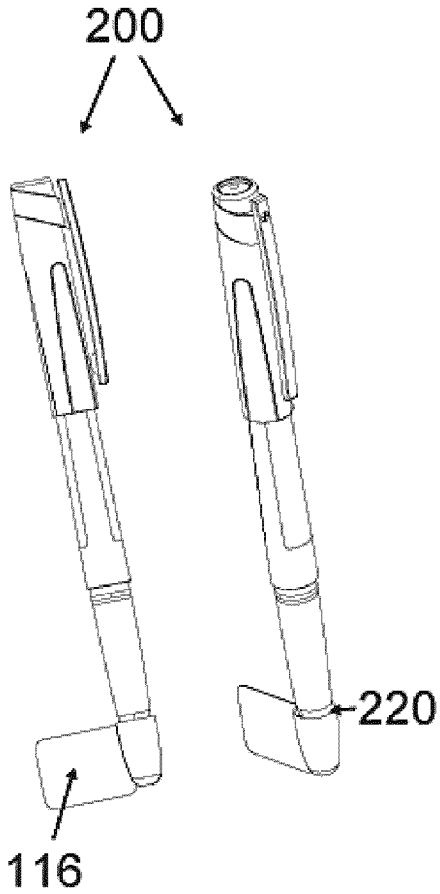

FIGS. 1A-H depict various views of an illustrative embodiment of a packaging of the present invention. FIG. 1A shows a front view of the packaging. FIGS. 1B and 1C show side views of the packaging. FIGS. 1D and 1E show top and bottom views, respectively, of the packaging. FIG. 1F shows a perspective view of the packaging. FIGS. 1G and 1H show perspective views of a writing instrument of the packaging. As illustrated, the packaging includes writing instruments.

Figure 2C:
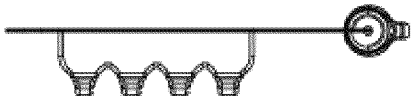
FIGS. 2A-D depict various views of an illustrative embodiment of a packaging of the present invention.
Figure 2B:
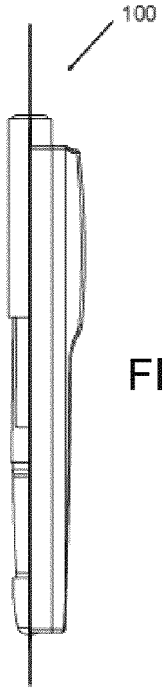
Figure 2A:
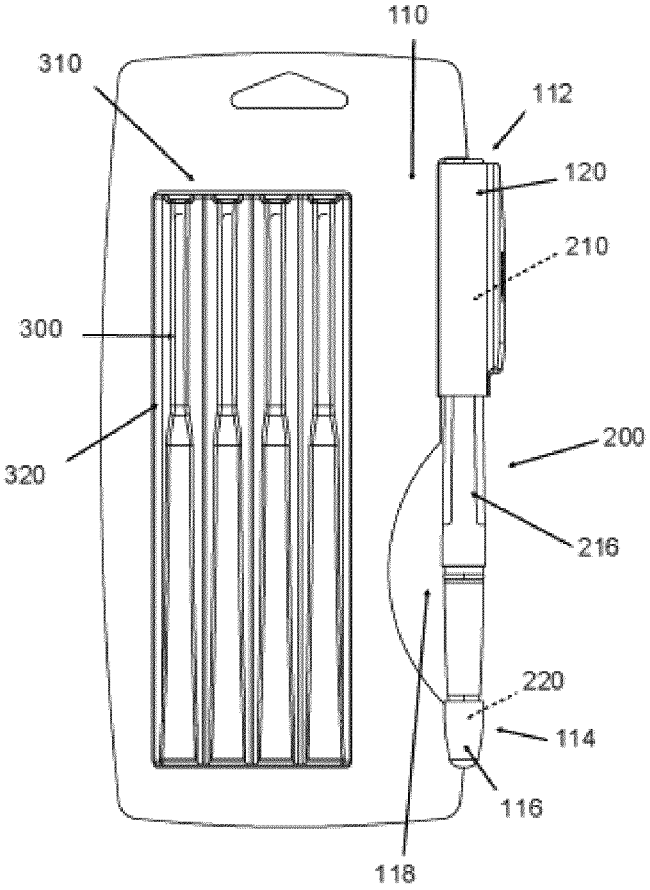
Figure 2D:
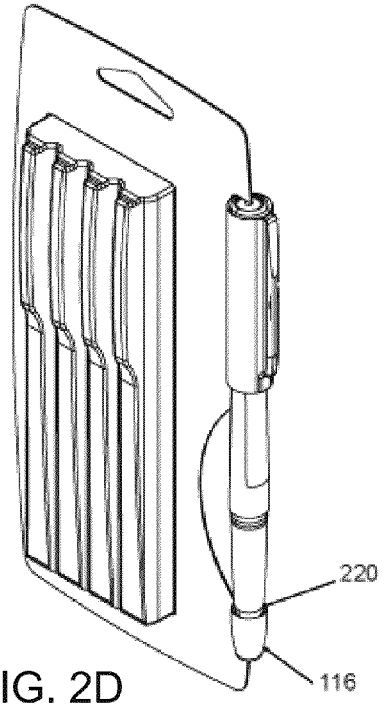

FIGS. 2A-D depict various views of an illustrative embodiment of a packaging of the present invention. FIG. 2A shows a front view of the packaging. FIG. 2B shows a side view of the packaging. FIG. 2C shows a top view of the packaging. FIG. 2D shows a perspective view of the packaging. As illustrated, the packaging includes writing instruments.

Figure 3C:
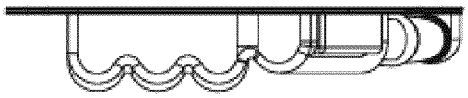
FIGS. 3A-F depict various views of an illustrative embodiment of a packaging of the present invention.
Figure 3A:
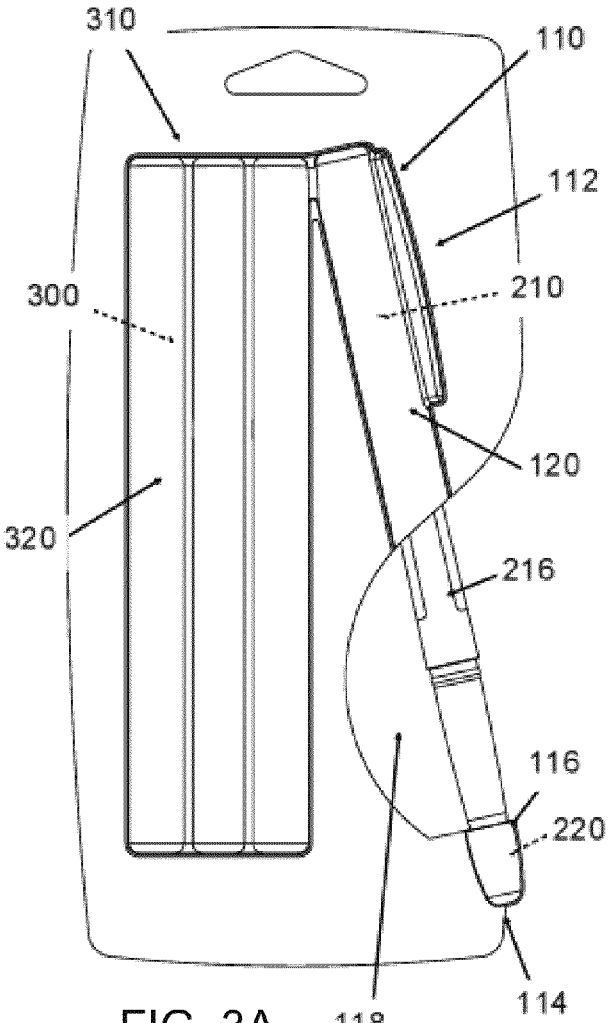
Figure 3B:
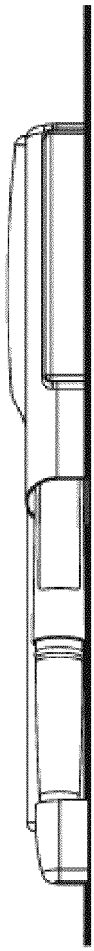
Figure 3D:
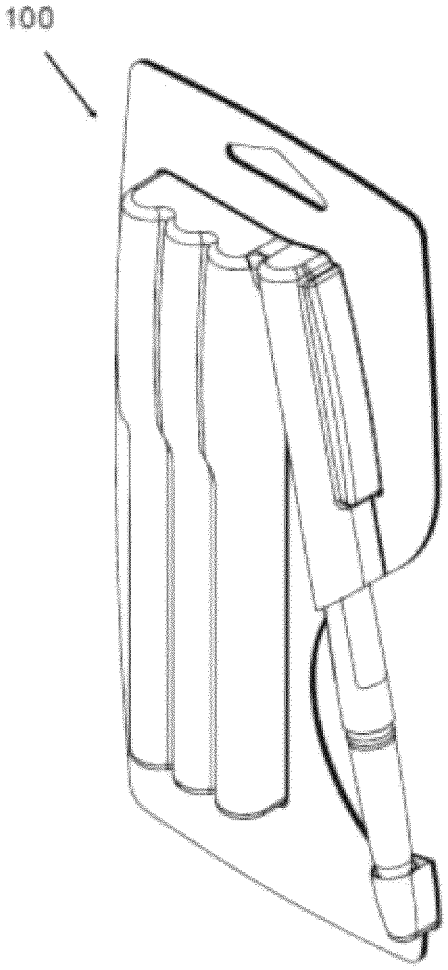
Figures 3E, 3F:
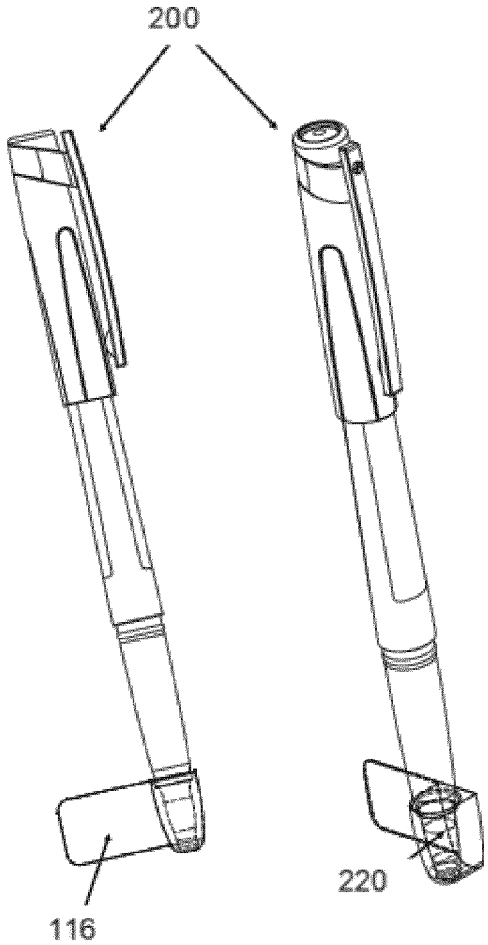

FIGS. 3A-F depict various views of an illustrative embodiment of a packaging of the present invention. FIG. 3A shows a front view of the packaging. FIG. 3B shows a side view of the packaging. FIG. 3C shows a top view of the packaging. FIG. 3D shows a perspective view of the packaging. FIGS. 3E and 3F show perspective views of a writing instrument of the packaging. As illustrated, the packaging includes writing instruments.

The packaging 100 includes a first section 110 comprising an upper section 112 configured to secure an upper portion 210 of a writing instrument 200 within the packaging 100. In an embodiment, the upper section 112 includes a sleeve 120 configured to secure the upper portion 210 of the writing instrument 200 within the packaging 100. The packaging 100 further includes a lower section 114 configured to secure a writing end 220 of the writing instrument 200 within the packaging 100. In an embodiment, the lower section 114 includes a cap sleeve 116 (see, for example, FIG. 1G) configured to prevent the writing end 220 of the writing instrument 200 from at least one of substantially evaporating dry or substantially leaking. In an embodiment, the cap sleeve 116 is vacuum-sealed to prevent evaporation of the ink. The packaging 100 further includes an intermediate section 118 configured to allow a user to grasp entirely a middle portion 216 of the writing instrument 200. The packaging 100 further includes a second section 310 configured to secure at least one additional writing instrument 300. In the embodiments illustrated in FIGS. 1A-H and FIGS. 3A-F, the second section 310 is configured to secure three additional writing instruments 300. In the embodiments illustrated in FIGS. 2A-D, the second section 310 is configured to secure four additional writing instruments 300. In an embodiment, the second section 310 includes a sleeve 320 (see, for example, FIG. 2A) configured to secure the at least one additional writing instrument 300 within the packaging 100. In an embodiment, the sleeve 320 of the second section 310 is made from an opaque material (see, for example, FIG. 3A). In an embodiment, the sleeve 320 of the second section 310 is made from a transparent material (see, for example, FIGS. 1A and 2A). The first section 110 of the packaging 100 is adjacent to the second section 310 of the packaging 100. In an embodiment, as illustrated in FIG. 1A and FIG. 3A for example, the writing instrument 200 of the first section 110 is substantially angled in the packaging 100 as compared with the additional writing instruments 300 of the second section 310 which are substantially linear in the packaging 100. In an embodiment, as illustrated for example in FIG. 2A, the writing instrument 200 of the first section 110 is substantially linear in the packaging 100 and the additional writing instruments 300 of the second section 310 are substantially liner in the packaging 100.

In an embodiment, the writing instrument is a pen. In an embodiment, the pen is selected from a ballpoint pen, a rollerball pen, a crowquill pen, a fountain pen and a felt-tip pen. In an embodiment, the pen includes a nib. In an embodiment, the nib is retractable. In an embodiment, the felt-tip pen is selected from a permanent marker, a highlighter, a non-permanent marker, a security marker and an election marker. In an embodiment, the writing instrument is a mechanical pencil.

In an embodiment, the upper portion of the writing instrument is an upper portion of a barrel. In an embodiment, the barrel of the writing instrument is generally tubular in shape. In an embodiment, the barrel of the writing instrument has a hollow channel extending therethrough. In an embodiment, the middle portion of the writing instrument is selected from at least one of a middle portion of a barrel or a touch grip. In an embodiment, when the user grasps entirely the middle portion of the writing instrument, the user feels a size and a shape of the middle portion of the writing instrument. In an embodiment, the intermediate section is configured to allow a left hand user and a right hand user to grasp entirely the middle portion of the writing instrument.

In an embodiment, the second section 310 encloses the entire additional writing instrument 300. In an embodiment, the second section 310 includes a cut-out window for touching a middle portion of the additional writing instrument 300. In an embodiment, the middle portion of the additional writing instrument 300 is selected from at least one of a middle portion of a barrel or a touch grip. In an embodiment, the writing instrument 200 of the first section is a same type as the additional writing instrument 300 of the second section. In an embodiment, the writing instrument 200 of the first section is a different type as the additional writing instrument 300 of the second section. In an embodiment, the additional writing instrument 300 is a pen. In an embodiment, the pen is selected from the group consisting of a ballpoint pen, a rollerball pen, a crowquill pen, a fountain pen and a felt-tip pen. In an embodiment, the felt-tip pen is selected from the group consisting of a permanent marker, a highlighter, a non-permanent marker, a security marker and an election marker. In an embodiment, the additional writing instrument 300 is a mechanical pencil.

All patents, patent applications, and published references cited herein are hereby incorporated by reference in their entirety. It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A packaging comprising:

a first section comprising:

a first writing instrument;

an upper section that encloses an upper portion of the first writing instrument within the packaging;

a lower section that encloses a writing end of the first writing instrument within the packaging; and an intermediate section entirely free of packaging, wherein a middle portion of the first writing instrument is unobstructed by packaging material and configured to allow a user's hand to grasp entirely the middle portion of the first writing instrument; and a second section comprising a second writing instrument, wherein the first section is adjacent to the second section.

2. The packaging of claim 1 wherein the first writing instrument is a pen.

3. The packaging of claim 2 wherein the pen is selected from the group consisting of a ballpoint pen, a rollerball pen, a crowquill pen, a fountain pen and a felt-tip pen.

4. The packaging of claim 3 wherein the felt-tip pen is selected from the group consisting of a permanent marker, a highlighter, a non-permanent marker, a security marker and an election marker.

5. The packaging of claim 1 wherein the first writing instrument is a mechanical pencil.

6. The packaging of claim 1 wherein the upper portion of the first writing instrument is an upper portion of a barrel.

7. The packaging of claim 1 wherein the upper section includes a sleeve configured to secure the upper portion of the first writing instrument within the packaging.

8. The packaging of claim 1 wherein the lower section includes a cap configured to prevent the writing end of the first writing instrument from evaporating dry.

9. The packaging of claim 1 wherein the middle portion of the first writing instrument is selected from at least one of a middle portion of a barrel or a touch grip.

10. The packaging of claim 1 wherein, when the user's hand grasps entirely the middle portion of the first writing instrument, the user feels a size and a shape of the middle portion of the first writing instrument.

11. The packaging of claim 1 wherein the intermediate section is configured to allow a left hand user and a right hand user to grasp entirely the middle portion of the first writing instrument.

12. The packaging of claim 1 wherein the second section encloses the entire second writing instrument.

13. The packaging of claim 1 wherein a middle portion of the second writing instrument is selected from at least one of a middle portion of a barrel or a touch grip.

14. The packaging of claim 1 wherein the first writing instrument of the first section is a same type as the second writing instrument of the second section.

15. The packaging of claim 1 wherein the first writing instrument of the first section is a different type as the second writing instrument of the second section.

16. The packaging of claim 1 wherein the second writing instrument is a pen.

17. The packaging of claim 16 wherein the pen is selected from the group consisting of a ballpoint pen, a rollerball pen, a crowquill pen, a fountain pen and a felt-tip pen.

18. The packaging of claim 17 wherein the felt-tip pen is selected from the group consisting of a permanent marker, a highlighter, a non-permanent marker, a security marker and an election marker.

19. The packaging of claim 1 wherein the second writing instrument is a mechanical pencil.

* * * * *